US008312808B2

(12) United States Patent
Shore et al.

(10) Patent No.: US 8,312,808 B2
(45) Date of Patent: Nov. 20, 2012

(54) BAR BUNDLER

(75) Inventors: T. Michael Shore, Princeton, MA (US); S. Mark Shore, Dudley, MA (US); Xiancheng Lu, Leicester, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 279 days.

(21) Appl. No.: 12/771,637

(22) Filed: Apr. 30, 2010

(65) Prior Publication Data

US 2011/0265667 A1 Nov. 3, 2011

(51) Int. Cl.
*B65B 27/10* (2006.01)
*B65B 13/02* (2006.01)

(52) U.S. Cl. ..... 100/7; 100/26

(58) Field of Classification Search ..... 100/7, 8, 100/14, 15, 26, 212; 140/54, 73, 93 A, 92.2; 414/746.7, 746.8; 53/587
See application file for complete search history.

(56) References Cited

U.S. PATENT DOCUMENTS 1,983,473 A * 12/1934 Leaver, Jr. ..... 100/7
3,427,958 A * 2/1969 Glasson ..... 100/7
3,497,084 A * 2/1970 Murrah ..... 414/21
3,956,982 A * 5/1976 Hill et al. ..... 100/212

FOREIGN PATENT DOCUMENTS

IT 1226193 B 12/1990
NL 7208653 A 12/1973

OTHER PUBLICATIONS

PCT International Search Report dated Sep. 1, 2011 corresponding to PCT Application No. PCT/US2011/032085 filed Apr. 12, 2011 (7 pages).

* cited by examiner

*Primary Examiner* — Jimmy T Nguyen

(57) ABSTRACT

An apparatus for bundling bars comprises an accumulator rotatable about a horizontal axis. The accumulator has a plurality of notches spaced angularly around its axis. A drive rotates the accumulator about its axis to sequentially locate the notches at a first station at which long bars are received in the notches and accumulated into batches; a second station at which the batches are tied into bundles; and a third station at which the bundles are delivered from the notches to a bundle collector.

12 Claims, 9 Drawing Sheets

BAR BUNDLER

BACKGROUND DISCUSSION

1. Field of the Invention

This invention relates in general to rolling mills producing hot rolled bars and other like long products, and is concerned in particular with an improved bar bundling apparatus.

As herein employed, the term "bars" is to be broadly interpreted to include the entire range of long products that are susceptible to being bundled, irrespective of their cross sectional shapes.

2. Description of the Prior Art

Mill customers are now demanding smaller bar bundles with weights of approximately 100 kg. Thus, in a modern day bar mill producing 100-150 metric tons/hr, if the mill is to operate at full capacity, the bundler must be able to cycle at a rate of 1,000-1,500 bundles/hr.

Conventional bundlers are hampered in their ability to do so because the steps in forming each bundle (accumulating a predetermined number of bars into a batch; tying the batch into a bundle; discharging the completed bundle) occur sequentially at a single location, which means that formation of the next bundle cannot begin until the previous bundle has been completed and discharged.

SUMMARY OF THE INVENTION

The objective of the present invention is to improve bundling efficiency by performing the successive bundling steps at different locations, with at least some of the bundling steps occurring simultaneously.

In accordance with the present invention, an accumulator has a plurality of angularly spaced peripheral notches. The accumulator is rotatable about a horizontal axis to sequentially position each peripheral notch at a succession of separate circumferentially spaced stations. These include a first station at which bars are received in the notches and accumulated in batches; a second station at which the batches of bars in the notches are tied into bundles; and a third station where the bundles are delivered from the notches to a bundle collector. At least the accumulation of bars into batches at the first station and the tying of the batches of bars into bundles at the second station are carried out simultaneously.

These and other features and attendant advantages of the present invention will now be described in greater detail with reference to the accompanying drawings, wherein:

DETAILED DESCRIPTION

Figure 1:
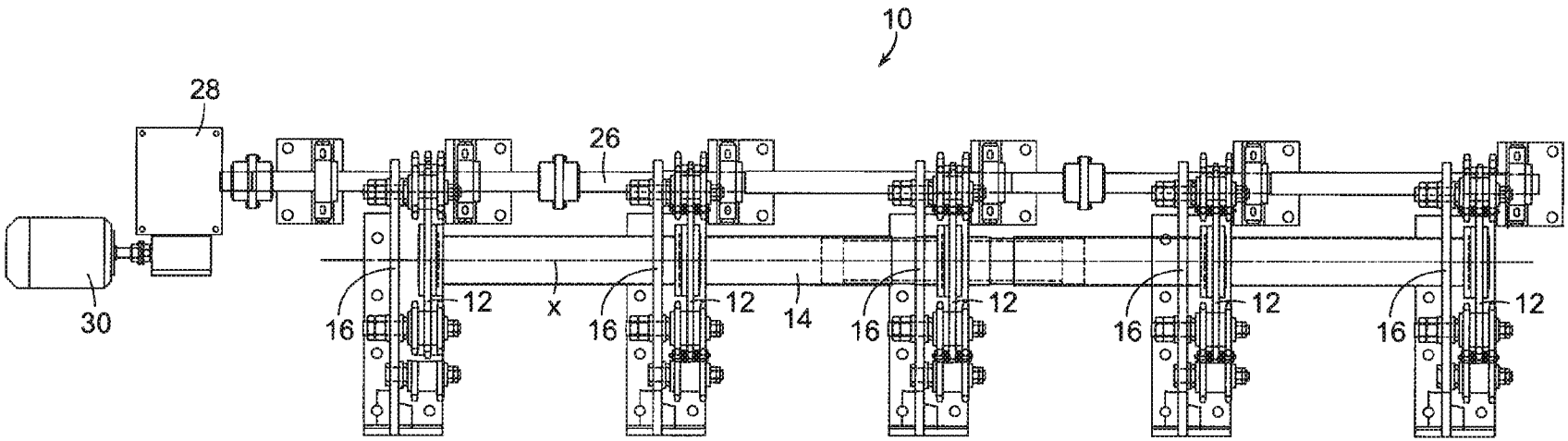
FIG. 1 is a plan view of a bundling apparatus in accordance with the present invention.
Figure 2:
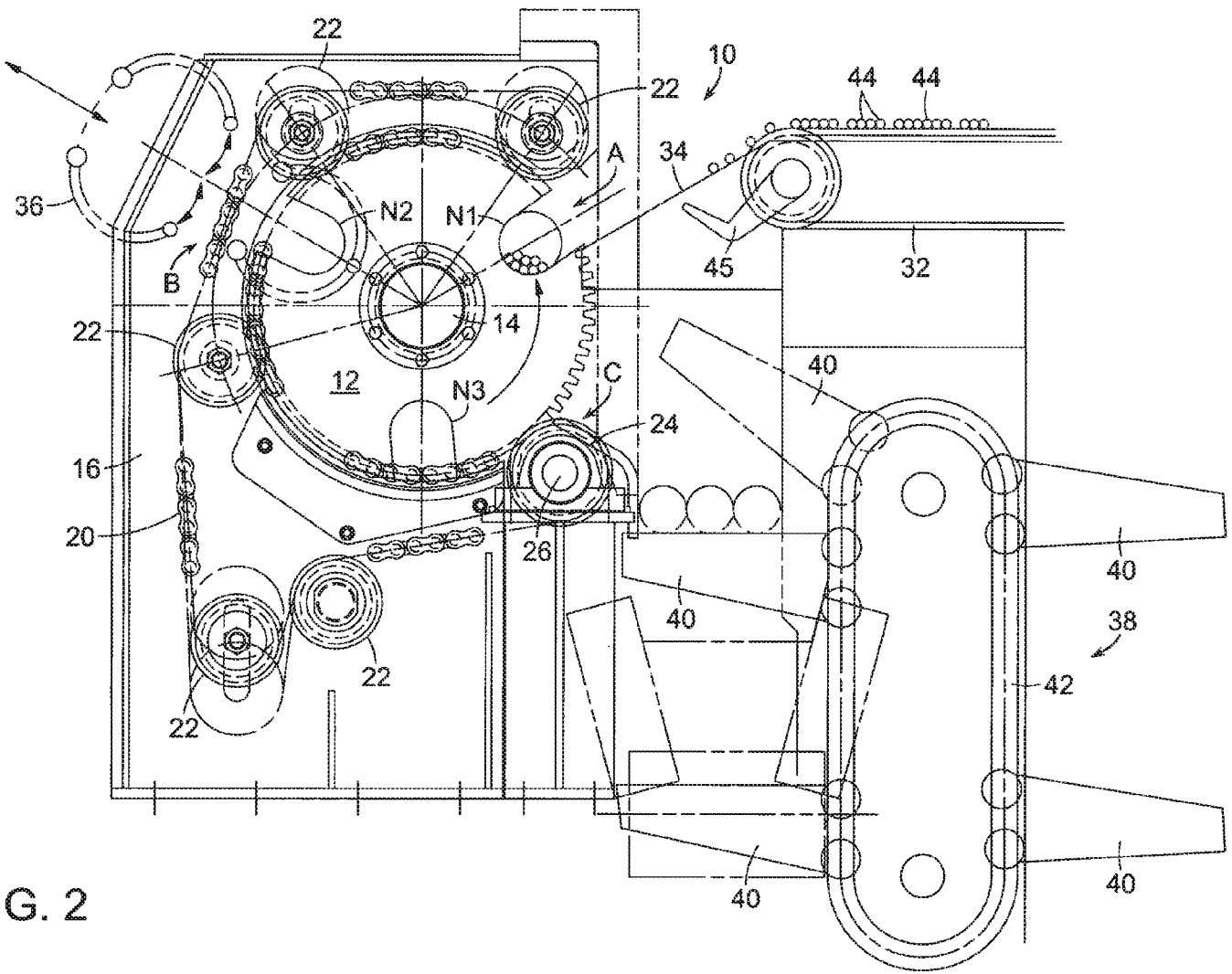
FIG. 2 is an enlarged cross sectional view taken along line 2-2 of FIG. 1.

With reference initially to FIGS. 1 and 2, an apparatus for bundling bars is shown at 10. The apparatus comprises an accumulator having a plurality of wheels 12 spaced along and rotatable in unison about a horizontal axis "X". The wheels are fixed to a common central shaft 14 rotatably supported at appropriate locations by bearings carried on support structures 16.

The wheels 12 have mutually aligned peripheral notches $N_1$-$N_3$ separated by peripheral toothed segments 18. The wheels 12 are driven for rotation about axis X by endless chains 20 partially wrapped around the wheels 12 in engagement with the toothed segments. The chains are guided by idler sprockets 22 and driven by drive sprockets 24. The drive sprockets 24 are carried on a shaft 26 parallel to axis X. Shaft 26 is rotatably driven via a gear box 28 by motor 30.

Figure 3:
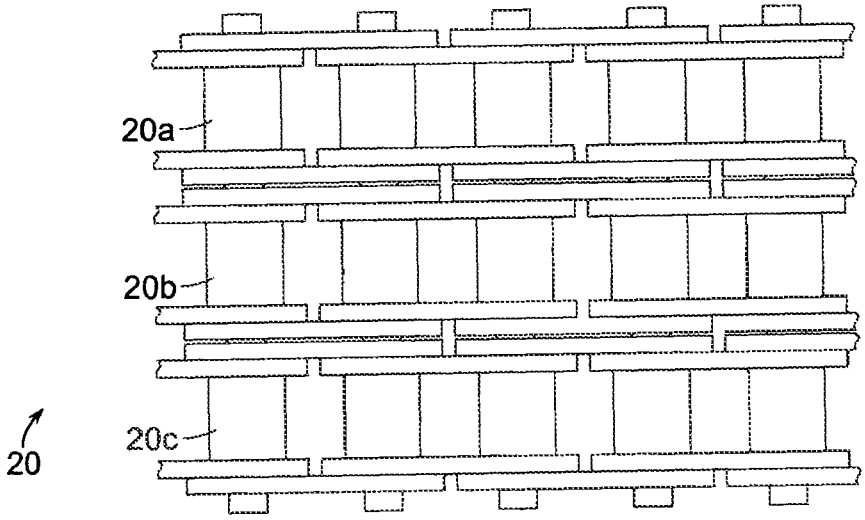
FIG. 3 is an enlarged cross sectional view taken along line 3-3 of FIG. 2.
Figure 4:
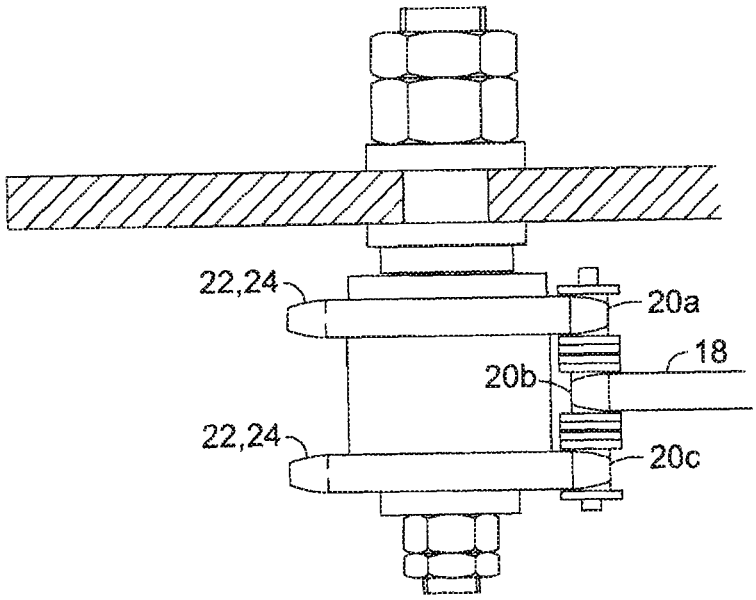
FIG. 4 is a partial plan view of a drive chain.
Figure 5A:
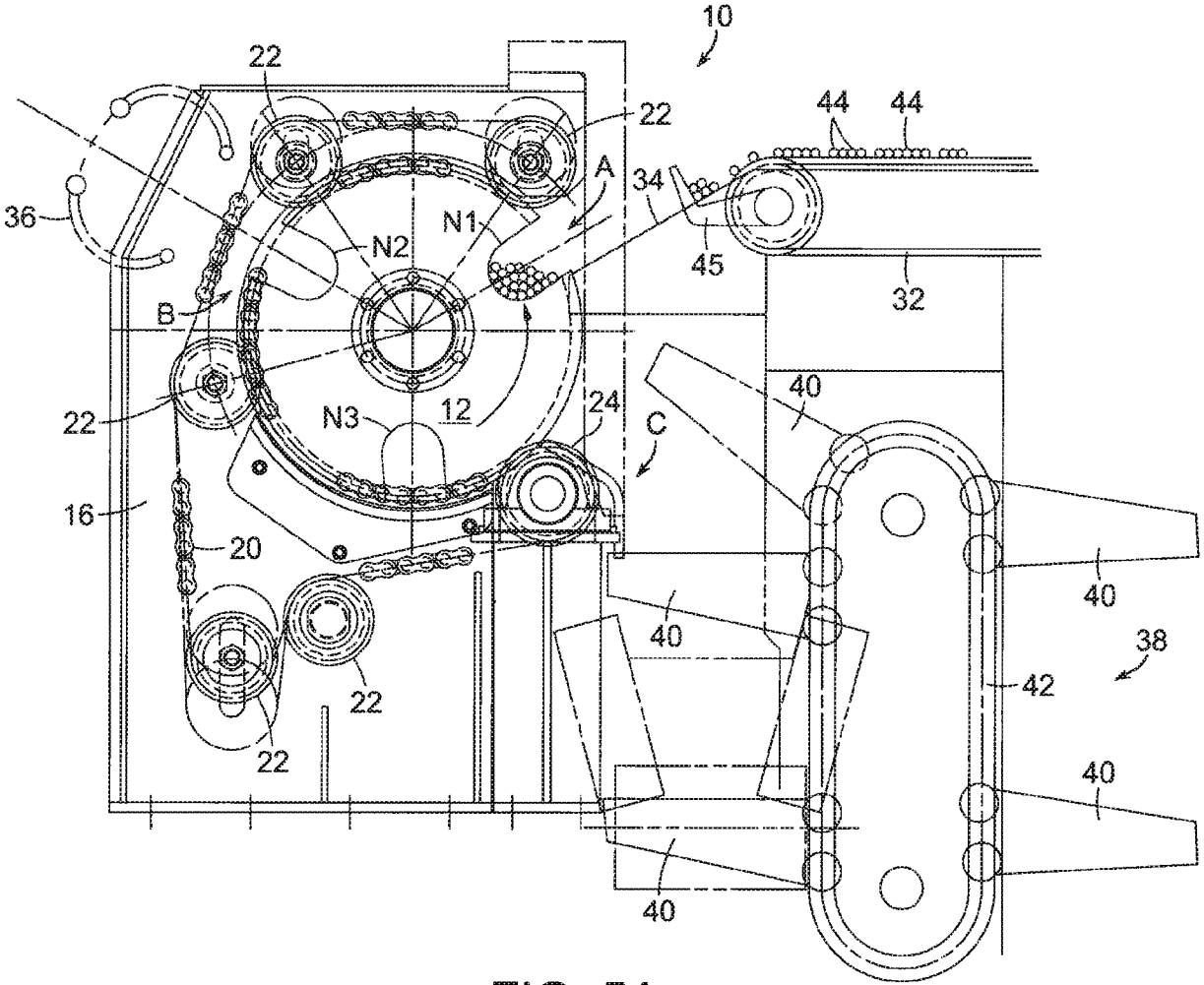
FIGS. 5A-5F are views similar to FIG. 2 showing successive stages of sequential bundling operations.
Figure 5B:
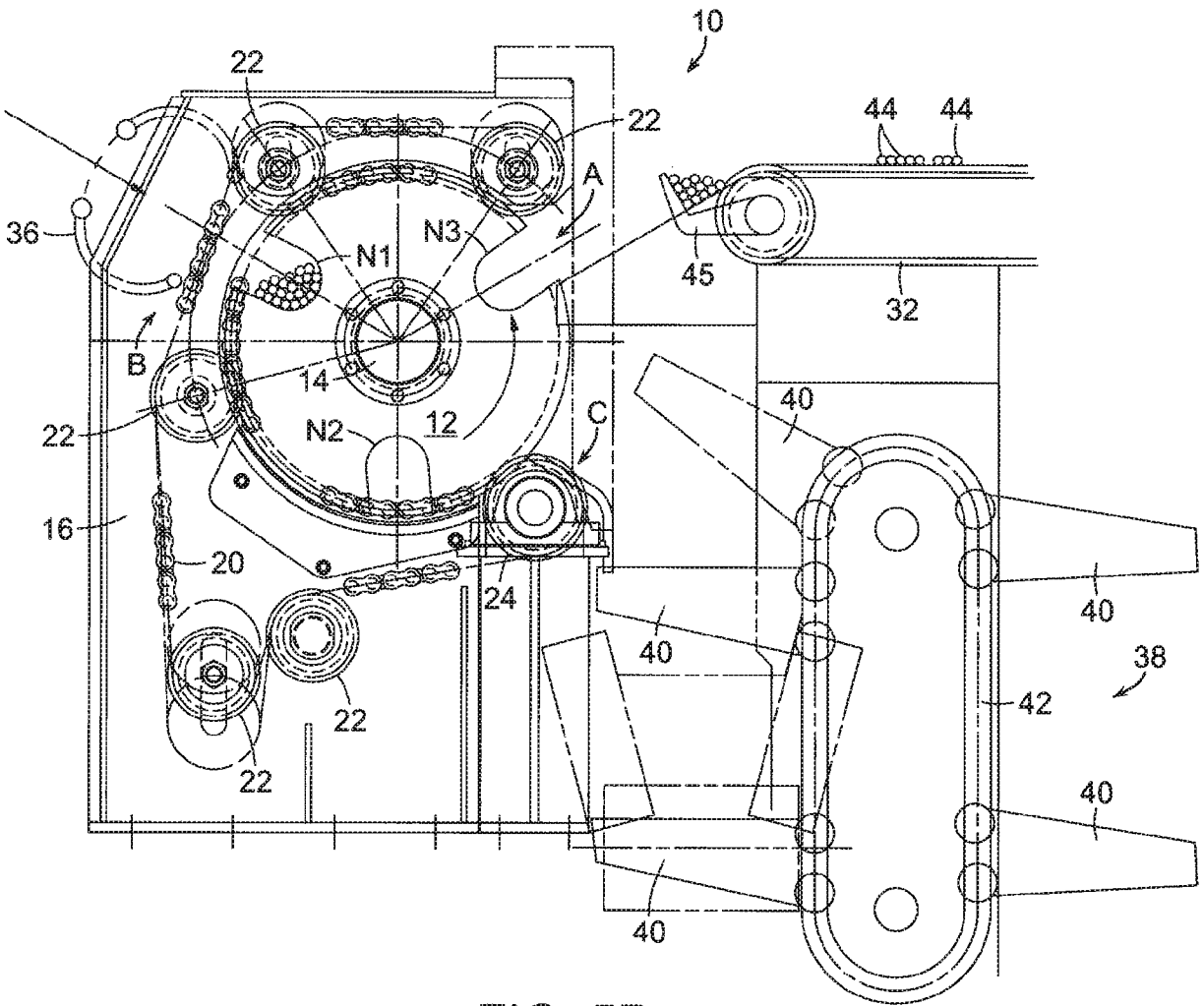
Figure 5C:
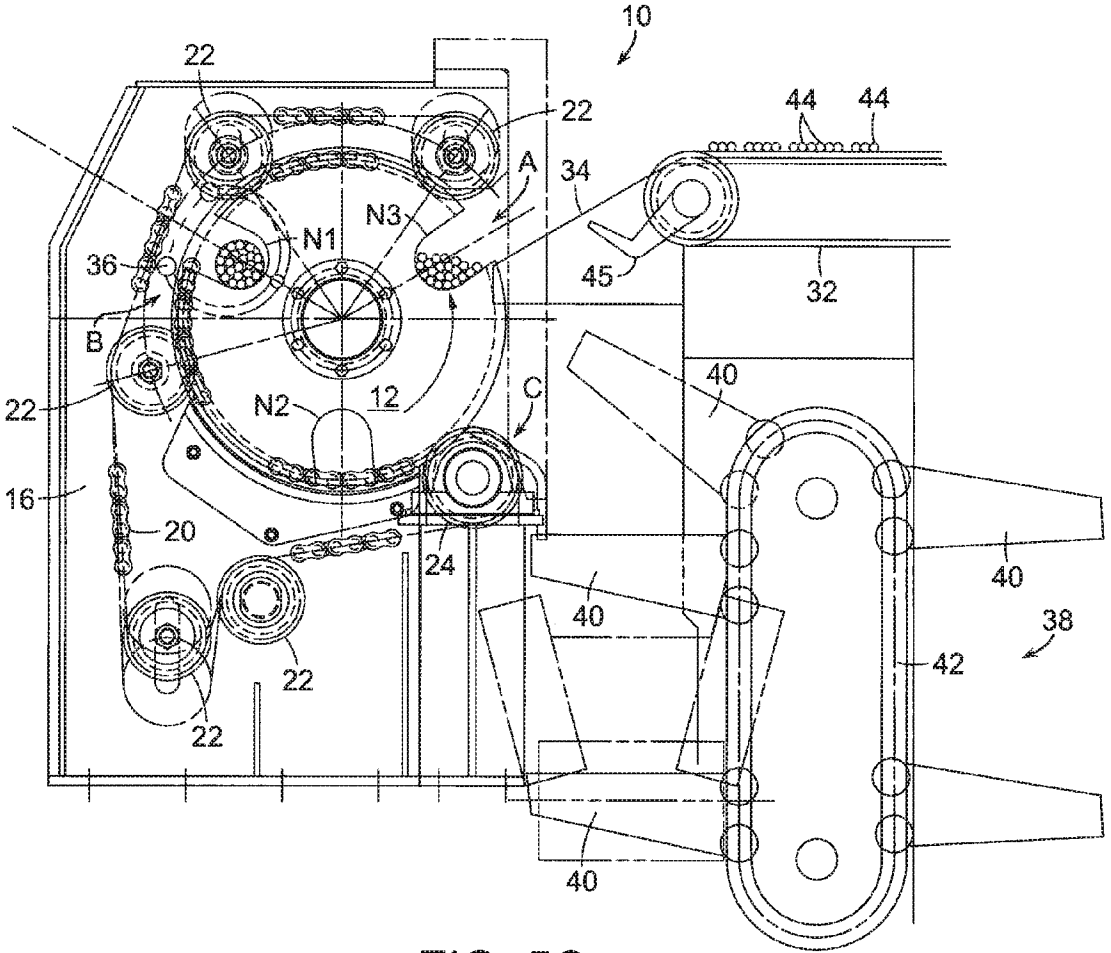
Figure 5D:
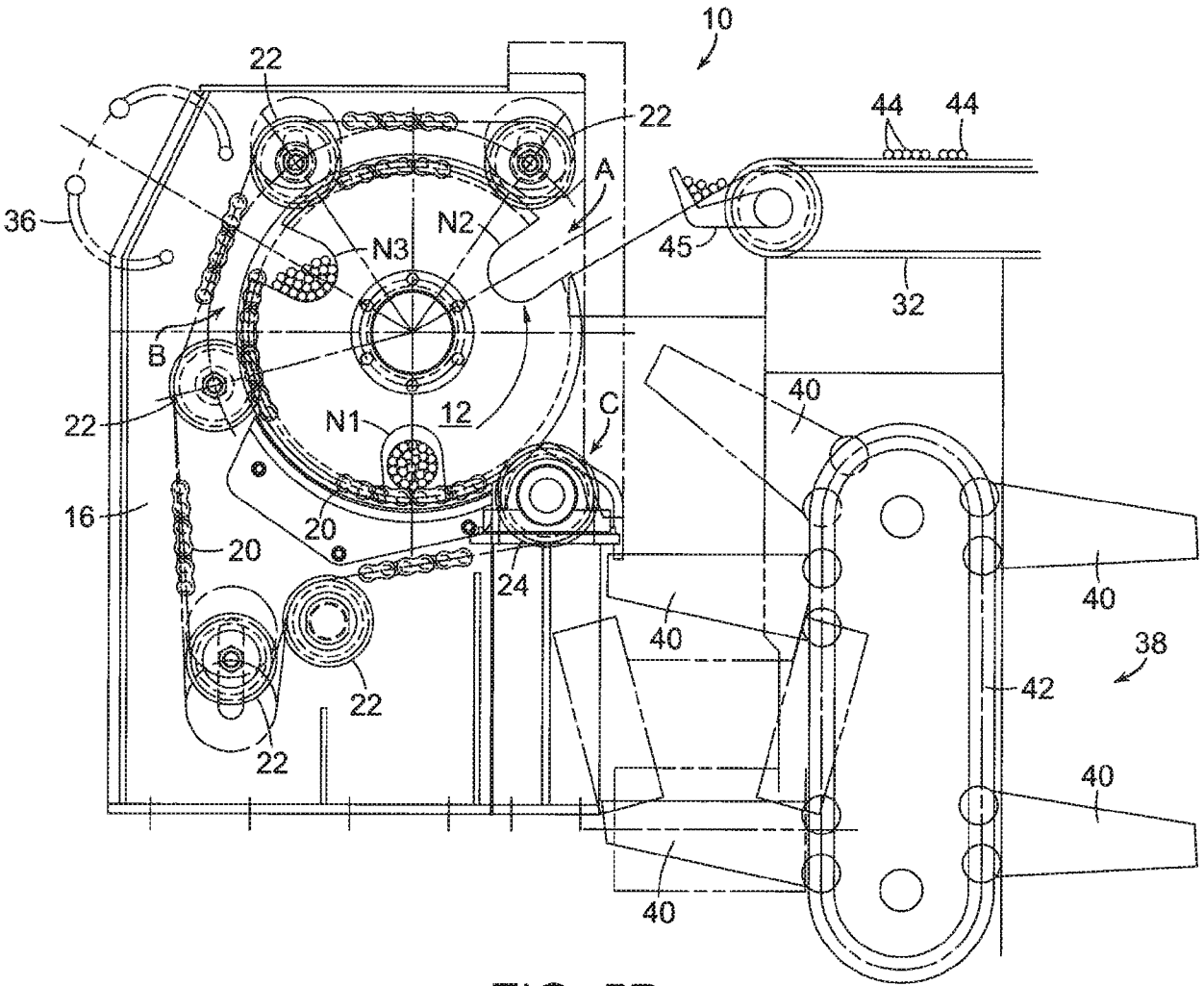
Figure 5E:
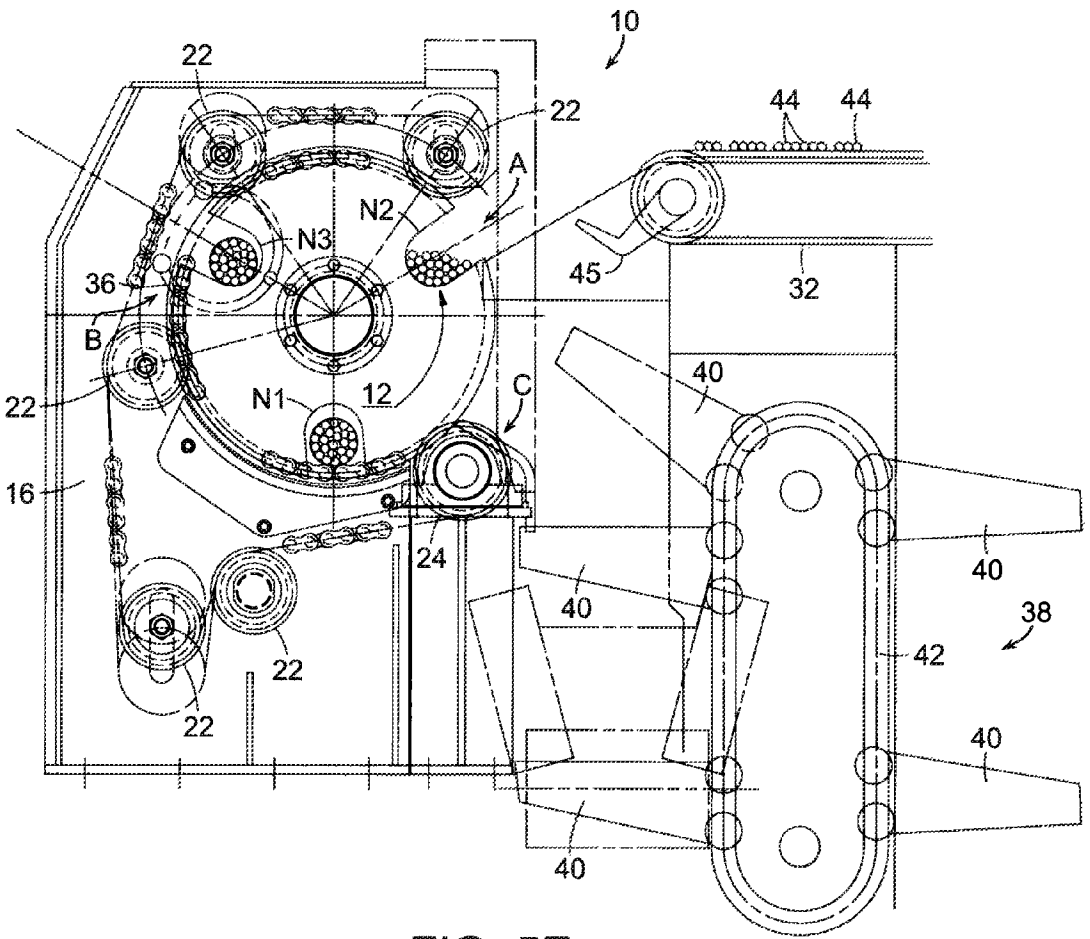
Figure 5F:
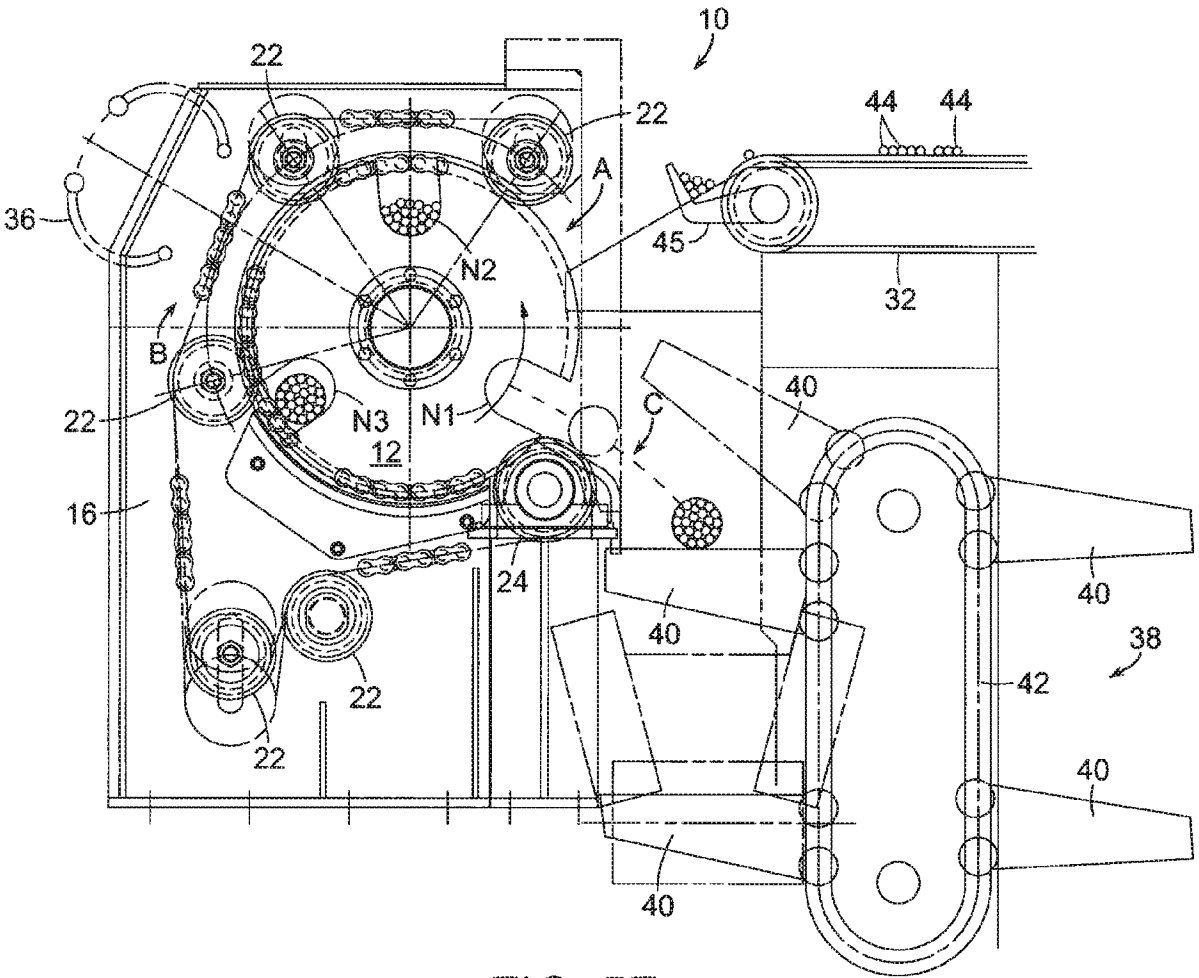

As can best be seen in FIGS. 3 and 4, the chains 20 have three strands 20*a*, 20*b*, 20*c*. The central strands $\mathbf{20}_b$ engage the toothed segments 18 of the wheels 12, and the outboard strands $\mathbf{20}_a$, $\mathbf{20}_c$ engage teeth on the sprockets 22, 24.

Again with reference to FIG. 2, it will be understood that the chains 20 are driven to rotatably index the wheels 12 about axis X to sequentially position the notches $N_1$-$N_3$ at circumferentially spaced stations A, B, and C. At station A, a bar delivery conveyor 32 leads to a downwardly inclined ramp 34. At station B, strapping machines 36 are arranged at appropriate intervals between the wheels 12. A bundle collector 38 is arranged at station C. The bundle accumulator has elevator arms 40 vertically adjustable by means of chains 42.

FIG. 2 illustrates the bundling apparatus at the outset of a bundling operation. Conveyor 32 is operating to deliver bars 44 down ramp 34 into notches $N_1$ located at station A. At this stage, notches $N_2$ and $N_3$ empty. With reference to FIGS. 5A to 5F, subsequent stages in the bundling operation are as follows:

FIG. 5A

A batch of bars has been accumulated at station A in the aligned notches $N_1$, and a stop 45 has been raised to interrupt the further descent of bars down ramp 34.

FIG. 5B

The wheels 12 have been rotatably indexed about axis X to position notches $N_1$ at a station B and to position notches $N_3$ at station A.

FIG. 5C

The strapping machines 36 are cycled to strap the batch of bars in notches $N_1$ into a bundle. The stop 45 has been lowered to allow the next batch of bars to descend ramp 34 and to accumulate simultaneously in notches $N_3$.

FIG. 5D

The strapping machines 36 are withdrawn, the stop 45 is raised, and the wheels 12 are again rotatably indexed to locate the batch of bars in notches $N_3$ at station B in preparation for the next strapping operation. The previously strapped bundle is retained in notches $N_1$ by the chains 20. Notches $N_2$ are positioned at station A in readiness to receive and accumulate the next batch of bars.

FIG. 5E

The batch of bars in notches $N_3$ are strapped into a bundle at station B while the next batch of bars is simultaneously accumulating in notches $N_2$ at station A.

FIG. 5F

The strapping machines 36 are withdrawn, and the stop 45 raised to again interrupt delivery of bars to the accumulator. As the wheels 12 rotate back to the positions shown in FIG. 2, a strapped bundle is delivered under gravity from notches $N_1$ onto an elevator arm 40 of the bundle accumulator 38.

The above described sequence of bar accumulation, batch strapping and bundle delivery may be operated continuously, with successive strapped bundles being delivered to the bundle accumulator 38.

By simultaneously performing accumulation of bars into batches at station A and the strapping of batches into bundles at station B, an important time savings is achieved in the processing of successive bundles, thus advantageously increasing overall efficiency of the bundling operation.

We claim:

1. Apparatus for bundling bars, comprising:

an accumulator rotatable about a horizontal axis, said accumulator comprising a plurality of wheels carried on and fixed relative to a rotatable support shaft extending along said axis, with a plurality of notches in the peripheries of said wheels spaced angularly around said axis, and with teeth in the peripheries of said wheels between said notches; and drive means for rotating said accumulator about said axis to sequentially locate said notches at:

a) a first station at which bars are received in said notches and accumulated in batches;

b) a second station at which said batches are tied into bundles; and c) a third station at which said bundles are delivered from said notches to a bundle collector;

said drive means comprising endless chains threaded around sprockets, with said sprockets being arranged to partially wrap said chains around the peripheries of said wheels and in engagement with said teeth.

2. The apparatus of claim 1 wherein said sprockets include both drive and idler sprockets, with said drive sprockets being carried on a drive shaft parallel to said support shaft.

3. The apparatus of claim 1 wherein said first and third stations are arranged adjacent to peripheral segments of said wheels that are not wrapped by said chains.

4. The apparatus of claim 3 wherein said second station is arranged adjacent to peripheral segments of said wheels wrapped by said chains.

5. The apparatus of claim 1 further comprising strapping machines movable radially with respect to said axis between operative positions projecting into notches located at the second station to thereby embrace and tie a batch of bars in said notches, and inoperative positions withdrawn from said notches.

6. The apparatus of claim 1 wherein said chains have a central strand located between two outboard strands, said central strand being in engagement with said teeth and said outboard strands being in engagement with said sprockets.

7. Apparatus for bundling bars, comprising:

stop means for receiving bars sequentially from a conveyor and for gathering said bars into batches;

an accumulator rotatable about a horizontal axis, said accumulator haying a plurality of notches spaces angularly around said axis;

drive means for rotating said accumulator about said axis to sequentially locate said notches at:

a) a first station at which said batches are delivered from said stop means into said notches;

b) a second station at which said batches are tied into bundles; and c) a third station at which said bundles are delivered from said notches to a bundle collector;

said accumulator comprising a plurality of wheels spaced along and rotatable in unison about said axis, with said notches being spaced around the peripheries of said wheels; said wheels being carried on and fixed to a rotatable support shaft extending along said axis, wherein teeth are provided in the peripheries of said wheels between said notches, and wherein said drive means comprises endless chains threaded around sprockets, with said sprockets being arranged to partially wrap said chains around the peripheries of said wheels in engagement with said teeth.

8. The apparatus of claim 7 wherein said sprockets include both drive and idler sprockets, with said drive sprockets being carried on a drive shaft parallel to said support shaft.

9. The apparatus of claim 7 wherein said first and third stations are arranged adjacent to the peripheral segments of said wheels that are not wrapped by said chains.

10. The apparatus of claim 9 wherein said second station is arranged adjacent to the peripheral segments of said wheels wrapped by said chains.

11. The apparatus of claim 7 further comprising strapping machines movable radially with respect to said axis between operative positions projecting into notches located at the second station to thereby embrace and tie a batch of bars in said notches, and inoperative positions withdrawn from said notches.

12. The apparatus of claim 7 wherein said chains have a central strand located between two outboard strands, said central strand being in engagement with said teeth and said outboard strands being in engagement with said sprockets.

* * * * *